US005107231A

United States Patent [19]

Knox

[11] Patent Number: 5,107,231

[45] Date of Patent: Apr. 21, 1992

[54] DIELECTRIC WAVEGUIDE TO TEM TRANSMISSION LINE SIGNAL LAUNCHER

[75] Inventor: Robert M. Knox, LaGrange, Ill.

[73] Assignee: Epsilon Lambda Electronics Corp., Geneva, Ill.

[21] Appl. No.: 357,345

[22] Filed: May 25, 1989

[51] Int. Cl.[5] ..... H01P 5/18; H01P 5/10

[52] U.S. Cl. ..... 333/109; 333/26; 333/34; 333/239; 333/251; 455/326; 385/125

[58] Field of Search ..... 333/26, 34, 113, 114, 333/116, 109, 239, 251; 350/96.32

[56] References Cited

U.S. PATENT DOCUMENTS

| | | | |
|---|---|---|---|
| 2,901,709 | 8/1959 | Fitzmorris | 333/116 X |
| 2,976,499 | 3/1961 | Sferrazza | 333/116 X |
| 3,558,213 | 1/1971 | Marcatili | 333/116 X |
| 3,990,026 | 11/1976 | Barlow . | |
| 3,995,238 | 11/1976 | Knox et al. . | |
| 4,034,377 | 7/1977 | Knox et al. . | |
| 4,048,589 | 9/1977 | Knox et al. . | |
| 4,072,902 | 2/1978 | Knox et al. . | |
| 4,091,343 | 5/1978 | Knox et al. . | |
| 4,097,826 | 6/1978 | Knox et al. . | |
| 4,215,313 | 7/1980 | Chang et al. . | |
| 4,222,014 | 9/1980 | Ondria . | |
| 4,232,401 | 11/1980 | Chang et al. . | |
| 4,259,647 | 3/1981 | Chang et al. . | |
| 4,415,871 | 11/1983 | Stern et al. . | |
| 4,426,628 | 1/1984 | Malecki et al. . | |
| 4,434,409 | 2/1984 | Green . | |
| 4,457,464 | 7/1984 | Forterre et al. . | |
| 4,459,567 | 7/1984 | Stern et al. . | |
| 4,463,330 | 7/1984 | Yoneyama . | |
| 4,502,023 | 2/1985 | Heitzmann . | |
| 4,507,664 | 3/1985 | James et al. . | |
| 4,547,901 | 10/1985 | Shibata et al. . | |
| 4,556,855 | 12/1985 | Chiang et al. . | |
| 4,654,609 | 3/1987 | Dixon, Jr. et al. . | |
| 4,673,897 | 6/1987 | Chua et al. . | |
| 4,673,946 | 6/1987 | Hoover . | |
| 4,689,584 | 8/1987 | Sequeira . | |
| 4,689,585 | 8/1987 | Sequeira . | |
| 4,742,571 | 5/1988 | Letron . | |
| 4,745,377 | 5/1988 | Stern et al. | 333/26 |
| 4,800,350 | 1/1989 | Bridges et al. . | |

FOREIGN PATENT DOCUMENTS

| | | | |
|---|---|---|---|
| 77403 | 4/1986 | Japan | 333/26 |

OTHER PUBLICATIONS

Stern, Richard A., et al., "Millimeter-Wave Microstrip Drop-In Circulators", *Microwave Journal, Apr., 1989, pp. 137-139.*

Henderson, A., et al., "New Low-Loss Millimeter-Wave Hybrid Microstrip Antenna Array", Department of Electrical and Electronic Engineering, Royal Military College of Science, Shrivenham, Swindon, Wilts, pp. 825-830.

*Primary Examiner*—Paul Gensler

*Attorney, Agent, or Firm*—Welsh & Katz, Ltd.

[57] ABSTRACT

Mode converting signal launchers for efficient coupling signals between dielectric insular and image waveguides and TEM mode transmission lines. The launcher includes a conductive ground plane and an elongated high permittivity dielectric waveguide adjacent to the ground plane. A TEM mode transmission line provides an elongated conductive strip fixed adjacent to the dielectric waveguide such that a coupling region is formed having a length of at least two times the wavelength in the dielectric waveguide.

21 Claims, 6 Drawing Sheets

DIELECTRIC WAVEGUIDE TO TEM TRANSMISSION LINE SIGNAL LAUNCHER

The present invention relates generally to improvements in high frequency communication systems and particularly to signal launchers for coupling signals to and from dielectric insular and image waveguide transmission lines to TEM mode transmission lines.

Waveguide transmission lines are widely used to channel the flow of high frequency electromagnetic energy. Common transmission lines are coaxial transmission lines, and planar transmission lines such as microstrip transmission lines, and dielectric waveguide transmission lines with ground plane. Dielectric waveguides includes image and insular waveguide transmission lines.

Image and insular waveguide transmission lines exhibit low loss at high frequencies such as in the 10 GHz to 300 GHz frequency range, and are therefore highly suitable for applications at such high frequencies. However, in the prior art, such dielectric waveguides have been difficult to integrate with active devices. Microstrip structures in which the electromagnetic energy propagates in a TEM mode have high loss at such high frequencies, but are highly suitable for integration of active devices. Thus, a high efficiency signal launcher for coupling between dielectric waveguides and microstrip structures, as well as other TEM structures, such as coaxial transmission lines would be advantageous and would facilitate construction of hybrid microwave and millimeter wave circuitry.

It is accordingly an object of the present invention to provide novel apparatus for coupling between dielectric waveguides and TEM waveguide structures such as microstrip and coaxial transmission lines.

It is another object of the present invention to provide novel distributed signal launchers for coupling between dielectric insular or image waveguides and microstrip or coaxial waveguides.

It is yet another object of the invention to provide a novel tapered waveguide signal launcher structure for distributed coupling between a dielectric waveguide and a TEM structure.

It is yet another object of the invention to provide a novel parallel waveguide signal launcher structure for distributed coupling between a dielectric waveguide and a TEM structure.

It is yet another object of the present invention to provide a novel crossed waveguide signal launcher structure for distributed coupling between a dielectric waveguide and a TEM structure.

It is yet another object of the present invention to provide a novel straddled waveguide signal launcher structure for distributed coupling between a dielectric waveguide and a TEM structure.

Briefly, according to one embodiment of the invention, apparatus is provided for a mode conversion signal launcher for coupling signals of a predetermined wavelength between a dielectric waveguide and a TEM mode transmission line. The launcher comprises a conductive ground plane and an elongated high permittivity dielectric waveguide of predetermined cross section adjacent to the conductive ground plane. A TEM mode transmission line is provided having an elongated conducting waveguide portion fixed adjacent to a portion of the dielectric waveguide such that the dielectric waveguide and conductive portions form a distributed coupling region having a length of least two times the predetermined wavelength.

BRIEF DESCRIPTION OF THE DRAWINGS

The invention, together with further objects and advantages thereof, may be understood by reference to the following description taken in conjunction with the accompanying drawings.

DETAILED DESCRIPTION OF THE PREFERRED EMBODIMENT

Figure 1A:
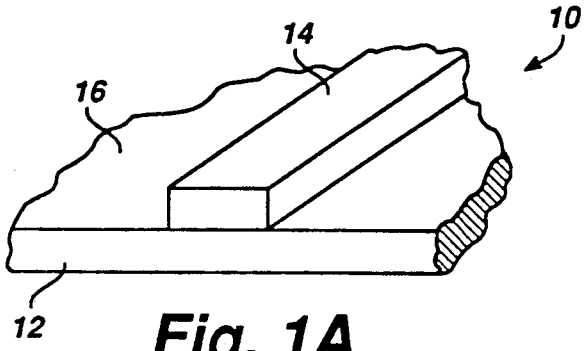
Fig. 1A Prior Art
FIGS. 1A, 1B, 1C, and 1D are illustrations of several prior art waveguide structures.
Figure 1B:
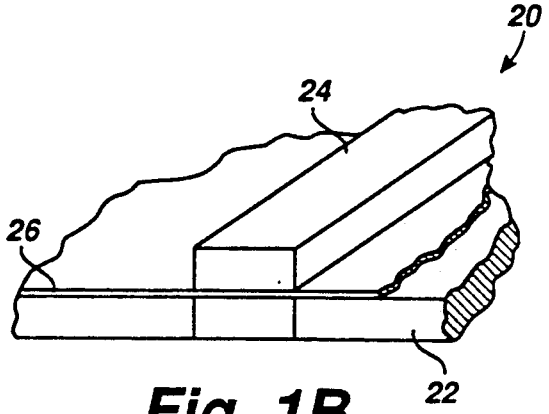
Fig. 1B Prior Art

FIG. 1A illustrates a prior art dielectric image waveguide structure 10 comprising a conductive metal ground plane (image plane) in the form of a conductive plate 12. An elongated dielectric waveguide 14 having a rectangular or square cross-section and composed of high permittivity (e.g. 10) dielectric material is mounted in intimate contact with the upper surface of the conductive image plate 12, as shown. A variation of the image dielectric waveguide is the insular dielectric waveguide structure 20 illustrated in FIG. IB. The insular waveguide structure 20 comprises a conductive base plate 22 (ground plane) and a dielectric waveguide 24 composed of a high permittivity (e.g., 10) dielectric material such as ceramic, alumina, quartz, ceramic filled synthetic organic resin, etc., as in the image waveguide structure. However, there is disposed between the conductive base plate 22 and the dielectric waveguide 24 a thin dielectric film 26 of low permittivity (e.g., less than 3) and low loss (e.g., loss tangent less than 0.001) such as a synthetic organic resin, e.g., polyethylene. The film extends laterally beyond the sides of the dielectric waveguide 24 and is intimately connected to both the base plate 22 and the dielectric waveguide 24. Although the dielectric waveguides 14,24 have been illustrated as being rectangular in cross section, other shapes may be used including hemispherical, trapezoidal, triangular, hexagonal, and the like. Such insular dielectric waveguides are known in the art, and are described in detail in a patent to Knox, et al., issued Nov. 30, 1976, U.S. Pat. No. 3,995,238, which is hereby incorporated by reference.

Figure 1C:
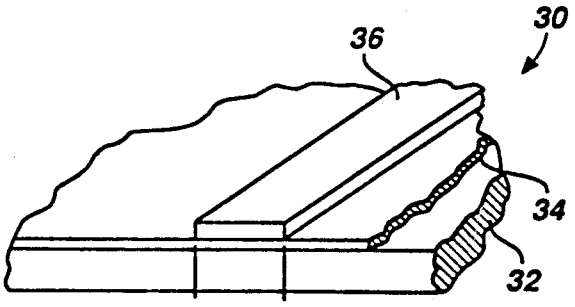
Fig. 1C Prior Art

While the above-described dielectric waveguides permit high frequency electromagnetic energy propagation in waveguide electromagnetic field modes such as the $E_{11}$ || mode, other widely utilized transmission line structures, particularly microstrip and coaxial transmission lines, permit propagation in the Transverse Electro-Magnetic (TEM) mode. FIG. 1C illustrates a microstrip structure 30 which comprises a conductive ground plane in the form of a conductive metal plate 32 with a dielectric layer 34 of various permittivities (e.g., typically 2.5 but as high as 10) affixed to the surface of the conductive plate 32. A conductive thin strip 36, typically metal, is mounted on the surface of the dielectric layer 34, as shown. Resulting structure may be fabricated in an integrated form with active device integrated directly with waveguide structures using the same dielectric and ground plane.

Figure 1D:
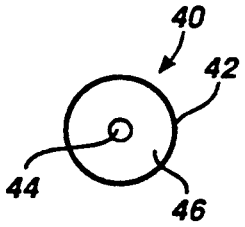
Fig. 1D Prior Art

FIG. 1D illustrates a coaxial transmission line structure 40 which comprises an outer conductor 42 and an inner conductor 44 which is surrounded by the outer conductor. A dielectric material 46 separates the inner conductor and the outer conductor. Both the microstrip structure and the coaxial structure propagate high frequency electromagnetic energy in the TEM mode while the dielectric waveguide structures 10, 20 propagate electromagnetic energy in hybrid modes such as the $E_{11}$ || mode.

While microstrip structures provide the basis for integrating active devices, they suffer from high loss and low Q at high frequencies (i.e., above 10 GHz). Further, microstrip permits the advantage of maintaining the purity of the propagation mode to the very contacts of the active devices in high frequency circuits so that impedance matching can be effectively and reproducible achieved. Conversely, dielectric waveguide structures are difficult to integrate with active devices (i.e., diodes, transistors, etc.) but exhibit much lower loss and higher Q characteristics at high frequencies. By combining these advantages of microstrip to permit integration of active devices and the low loss, high Q characteristics of dielectric waveguides, substantial circuit improvements can be obtained. However, since electromagnetic energy propagates in different modes in the dielectric waveguides than in microstrip waveguides, any interconnection between them requires a mode converting signal launcher.

Figure 2A:
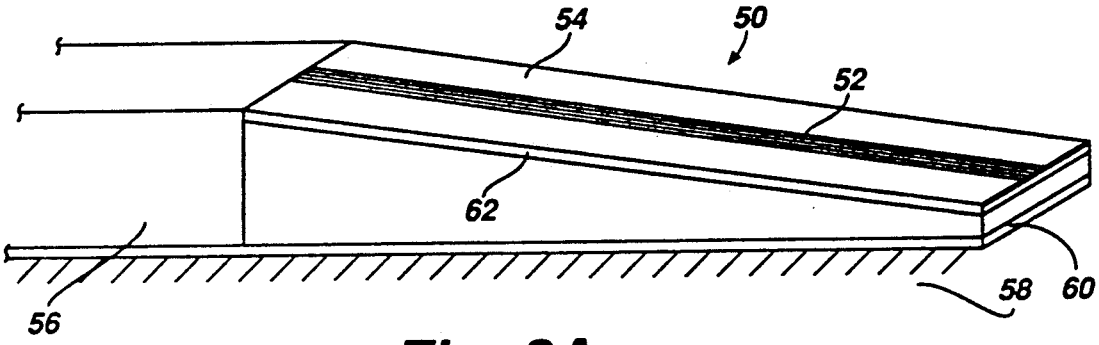
FIGS. 2A is a schematic representation illustrating a tapered signal launcher according to the invention.

FIG. 2A illustrates a tapered structure mode converting signal launcher 50 which may function, for example, as a launcher for converting $E_{11}$ || mode to TEM mode. The tapered launcher 50 converts the $E_{11}$ || mode to the TEM mode through the interaction of a thin conductive strip 52 on a tapered portion 54 of a dielectric waveguide 56 with the fringe fields of the $E_{11}$ ||. Thus a coupling region is formed in which the dielectric waveguide 56 is configured adjacent to the conductive strip 52 to provide mode conversion and signal coupling.

The tapered launcher 50 comprises a tapered portion 54 which tapers towards an image plane 58, which is typically a conductive plate or thin conductive layer. The tapered portion 54 is mated to the dielectric waveguide 56 by a butting connection, or may be integral with the waveguide 56. In the illustrated embodiment, the tapered portion 54 and the waveguide 56 may be made, for example, of alumina. The tapered portion 54 preferably has a height and width at one end to permit mating with the dielectric waveguide 56 while the other end has a substantially reduced height, and may have a width the same as that of the dielectric waveguide 56. The height at the low end is selected to provide physical compatibility and impedance matching to the TEM structure to which it is coupled. The length of the tapered portion 54 is also selected to allow gradual conversion of the $E_{11}$ || mode to the TEM mode and should be at least several times the wavelength in the dielectric waveguide to provide a low VSWR and high coupling efficiency. Typically, a length of 4 to 10 wavelengths is preferred; thus, for example, at 94 GHz, a length of 5 to 15 millimeters will be preferred.

The dielectric waveguide 56 and the tapered portion 54 may optionally have a thin insular layer 60 of low permittivity material, for example, polyethylene resin, disposed between them and the conductive image plane 58 to form an insular waveguide structure. An insular film 62 may also be applied in the preferred embodiment, to the top surface of the tapered portion 54. In the illustrated embodiment, this film preferably has low permittivity (e.g., 2.25) similar to the insular film 60 between the image plane 58 and the dielectric waveguide 56.

The thin conductive strip 52 is deposited on top of the insular film 62, as shown, and may typically have a width of 0.2 to 0.4 millimeters in a 94 GHz application. The conductive metal strip 52 may also be deposited directly on the tapered surface, and may have a variety of widths and shapes. For example, FIG. 2E illustrates a tapered launcher 120 coupling a dielectric waveguide 122 to a diode 124 on a microstrip circuit 125 with a thin conductive strip 130 having a diamond shape. The thin conductive strip of the tapered launcher structure 50 is connected directly to a thin conductive strip of the desired TEM structure such as a microstrip transmission line or a coaxial transmission line, thereby providing mode converting coupling between the dielectric waveguide and the TEM structure.

As a typical example of suitable dimensions for an $E_{11}$ ||/TEM mode launcher using an alumina waveguide to couple to a microstrip structure at 70 GHz, the launcher may typically have a coupling region length of 6 to 10 millimeters, a width of 0.625 millimeters, a height of 0.6 millimeters at the high end, a height of 0.05 millimeters at the low end, and an insular film thickness for both insular films of 0.075 millimeters.

The launcher 50 of FIG. 2A may also be used as a mode launcher between other propagation modes and TEM mode. For example, a Quasi-Optical mode waveguide using a larger dimension alumina dielectric waveguide with a cross section of approximately 1.5 millimeters height by 2.5 millimeters width may be used at frequencies in the 100 to 300 GHz range. In such an application, the length of the tapered portion 54 is preferably a larger number of wavelengths in length (i.e., 10 to 50 wavelengths) giving a length of 6 to 30 millimeters. Thin insular layers of 0.025 millimeters may also be preferred for such an application.

In operation, the tapered signal launcher 50 as illustrated in FIG. 2A has exponentially decaying fields (evanescent fields) existing at all surfaces of the waveguide. If any discontinuity is associated with the dielectric/air interface, conversion of the field energy from the $E_{11}$ || mode to other guided or radiated modes may occur. Thus, in the preferred embodiment, the mode launcher 50 is most efficient if the conductor 52 is not in direct contact with the tapered dielectric surface. In the preferred embodiment of the launcher 50, the conductive strip 52 intercepts only the fringe (evanescent) fields. This minor perturbation of the fringe fields allows the $E_{11}$ || mode to continue virtually unperturbed. Currents excited in the conductor 52 and the ground plane 58 by the fringe fields cause the formation of the field pattern of the TEM mode. Further into the tapered portion 54, the impedance of the $E_{11}$ || mode decreases and more energy couples into the fringe fields, which causes more coupling into the TEM mode. The conversion is thus highly efficient because there is very little conversion to radiation or to other modes which do not couple to the TEM mode.

Figure 2B:
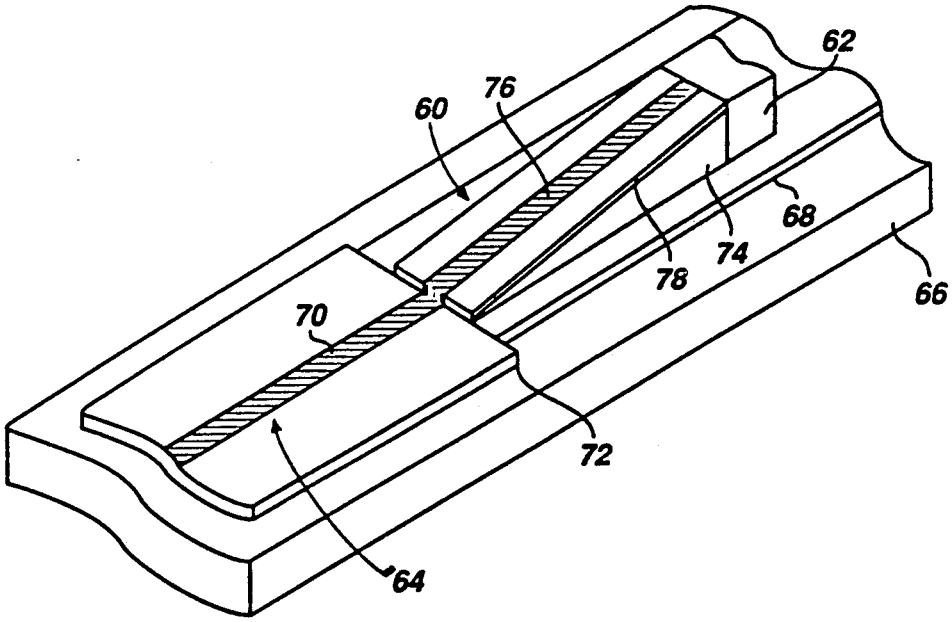
FIGS. 2B is a schematic representation illustrating a tapered signal launcher coupled to a microstrip structure.

Referring now to FIG. 2B, there is shown a schematic representation of a tapered launcher 60 coupled between a dielectric insular waveguide 62 and a microstrip transmission line 64. The dielectric insular waveguide comprises an elongated rectangular cross-section dielectric waveguide 62 mounted on an image plane in the form of a conductive plate 66 with an insular film 68 dispersed therebetween. The microstrip transmission line 64 comprises a thin conductive strip 70 mounted on a dielectric substrate 72 which is fixed to the conductive plate 66. The conductive plate 66 may be a single unified conductive plate or separate plates in conductive contact with each other.

The tapered launcher 60 comprises a tapered dielectric portion 74 mounted on the insular film 68 which is fixed to the conductive plate 66, as shown. The insular film 68 would not be present for an image waveguide structure. In the preferred embodiment, another insular film 78 covers the top surface of the tapered portion 74. The edge of the insular film 68 and the lower end of the tapered portion 74 abut the edge of the dielectric substrate 72 and the conductive waveguide 70, as shown. The conductive strip 70 is conductively connected with the conductive strip portion 76 which is mounted on the surface of the insular film 78, as shown. With this structure, the tapered launcher couples the TEM mode signals from the microstrip transmission line to, for example, a $E_{11}$ || of the dielectric insular waveguide 60 or conversely from the dielectric insular waveguide 60 to the TEM mode of the microstrip transmission line.

Figure 2C:
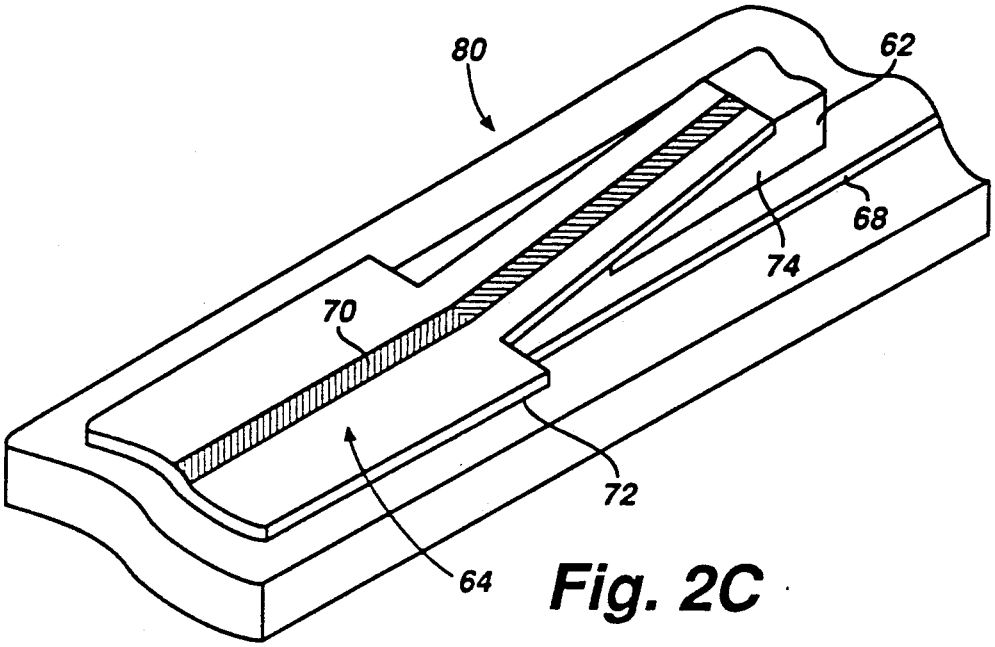
FIGS. 2C is a schematic representation illustrating an alternative tapered signal launcher structure coupled to a microstrip structure.

FIG. 2C illustrates another embodiment of a tapered launcher 80, which is an alternative to the structure of the tapered launcher 60 of FIG. 2B, for coupling between an image or insular dielectric waveguide 62 and a microstrip transmission line 64. In the embodiment of FIG. 2C, the insular film of the top surface of the tapered portion 74 is formed by a continuation of the dielectric substrate layer 72 which is bent upward and continued over the surface of the tapered portion 74, as shown. The conductive film 70 may also simply be continued up to the upper end of the tapered portion 74. Thus, the structure of the tapered launcher 80 is similar to that of the embodiment of FIG. 2B except that the dielectric substrate 72 and the conductive film 70 of the microstrip transmission line structure continue up the tapered portion 74 of the launcher. In the event that a nonbendable dielectric layer 72 is used, the entire microstrip structure can be mounted in an angle to the dielectric waveguide structure corresponding to the angle of the tapered portion 74 so that the dielectric layer 72 can be continuous without having to be bent.

Figure 2D:
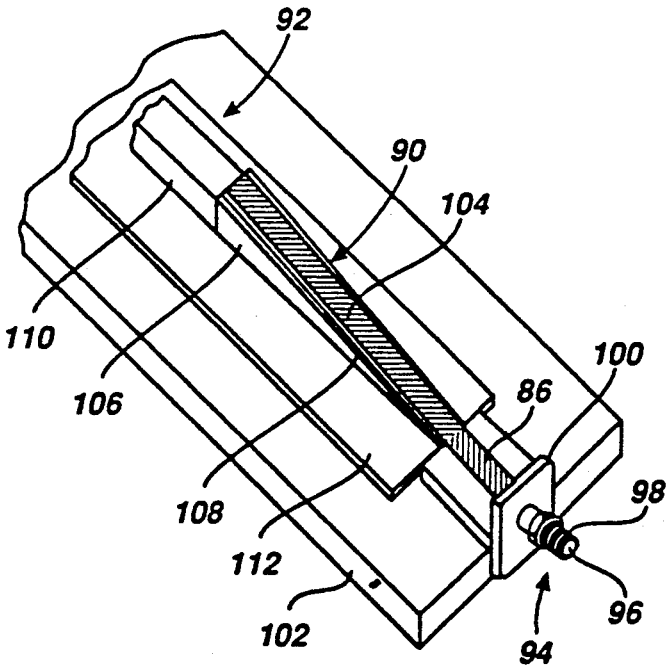
FIGS. 2D is a schematic representation illustrating a tapered signal launcher coupled to a coaxial transmission line.
Figure 2E:
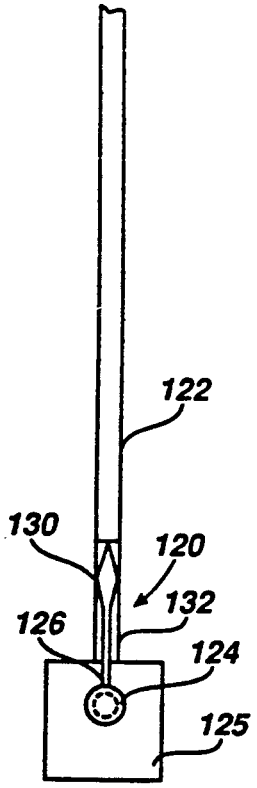
FIG. 2E is a schematic representation illustrating an alternative shape to the metal conductive waveguide of the tapered launcher of FIG. 2A.

Referring to FIG. 2D, there is shown a tapered launcher 90 interconnecting a dielectric waveguide 92 and a coaxial transmission line connector 94. A coaxial transmission line comprises a center conductor 44 and an outer conductor 40 (see FIG. 1D) which is coupled to the inner conductor 96 and outer conductor 98 of the connector 94. This connector is mounted on a flange 100 such that the outer conductor couples conductively to the flange 100 and the flange 100 is conductively attached to a conductive ground plane 102, as shown. As a result, the outer conductor 98 is conductively connected to ,the conductive plate 102. The center conductor 96, which functions as a transmission line is disposed along the tapered surface of the insular film 108 on the tapered dielectric waveguide region 106. A thin insular film 108 is disposed between the center conductor 96 and the surface of the tapered portion 106. The tapered portion 106 abuts a waveguide dielectric 110, as shown. Both the dielectric waveguide 110 and the tapered portion 106 are mounted on the conductive plate 102 which forms an image plane. If an insular waveguide is desired, an insular film 112 is disposed between the plate 102 and the waveguide dielectric 110 as well as under the tapered portion 106, as shown. FIG. 2E is a diagram illustrating a tapered launcher 120 coupling a dielectric waveguide 122 to a diode mounted on a microstrip circuit 125 with a microstrip transmission line coupling between the diode 124 and the launcher 120. A diamond shape conductive waveguide portion 130 is utilized for impedance matching in conjunction with the tapered dielectric portion 132, as shown.

Figure 3:
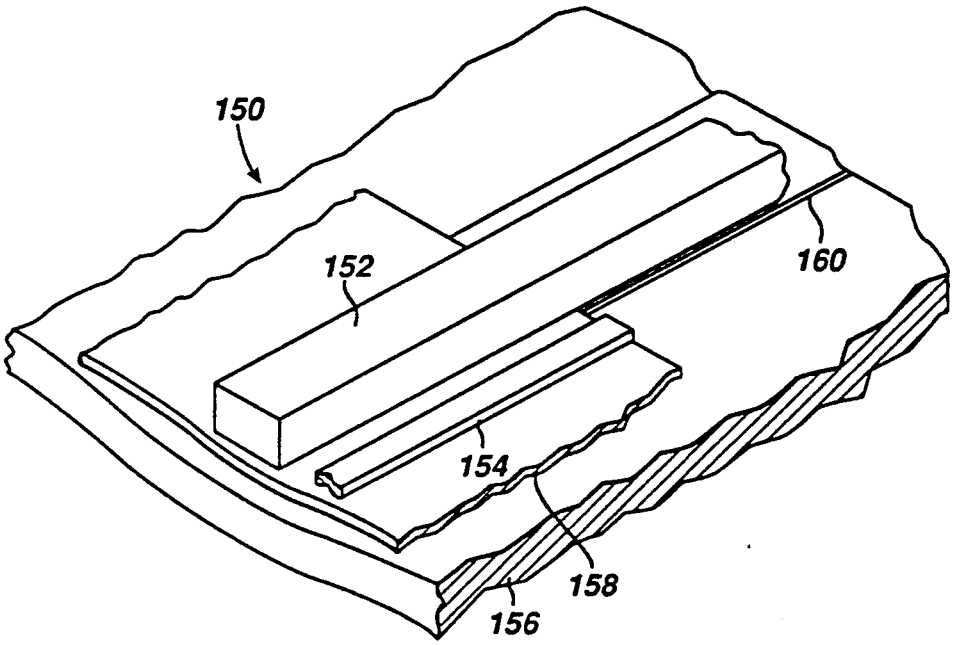
FIG. 3 is a schematic representation illustrating a parallel waveguide structure signal launcher according to the invention.

Referring to FIG. 3, there is shown another embodiment of a distributed signal launcher 150 according to the invention. The launcher 150 utilizes a coupling region comprising a region in which a dielectric waveguide 152 of high permittivity (e.g., 4 to 100) and a conductive strip transmission line 154 are configured in parallel and in close proximity along a length sufficient to mode convert and couple a signal from one waveguide to the other. In the illustrated embodiment, a microstrip structure comprises a conductive ground plane 156 covered with a layer of dielectric substrate material 158 of intermediate permittivity (e.g., 2 to 8) on which the conductive strip 154 is mounted. An insular waveguide comprises the conductive ground plane 156 on which the dielectric waveguide 152 is mounted with an insular film 160 disposed there between, as shown. The launcher 150 comprises a coupling region in which a portion of the dielectric waveguide 152 continues for a predetermined length over the dielectric layer 158 and parallel to the conductive strip transmission line 154. In the illustrated embodiment, the distance between the two waveguides 152, 154 in the coupling region is preferably less than the width of the conductive strip 154. In addition, it is preferable that the permittivity of the layer 158 be much less (e.g., 2 to 10 times less) than that of the dielectric waveguide 152. In addition, the thickness of the dielectric layer 158 is preferably a conventional value selected to be small enough to suppress horizontal polarization modes in the dielectric waveguide and large enough to obtain acceptable impedance and loss characteristics. For example, typical dimensions for a 90 GHz application would be a thickness of the dielectric layer 158 of 0.05–0.20 millimeters, a distance between waveguides 152, 154 of 0.03 millimeters, a width of the conductive strip 154 of 0.05 millimeters, and dimensions of 0.6 millimeters width and 0.5 millimeters height for the dielectric waveguide. Typical permittivity values, may be 2.25 for the dielectric layer 158 and 10 for the dielectric waveguide 152, while the preferred length of the coupling region is in the range of 3–20 wavelengths.

Figure 4:
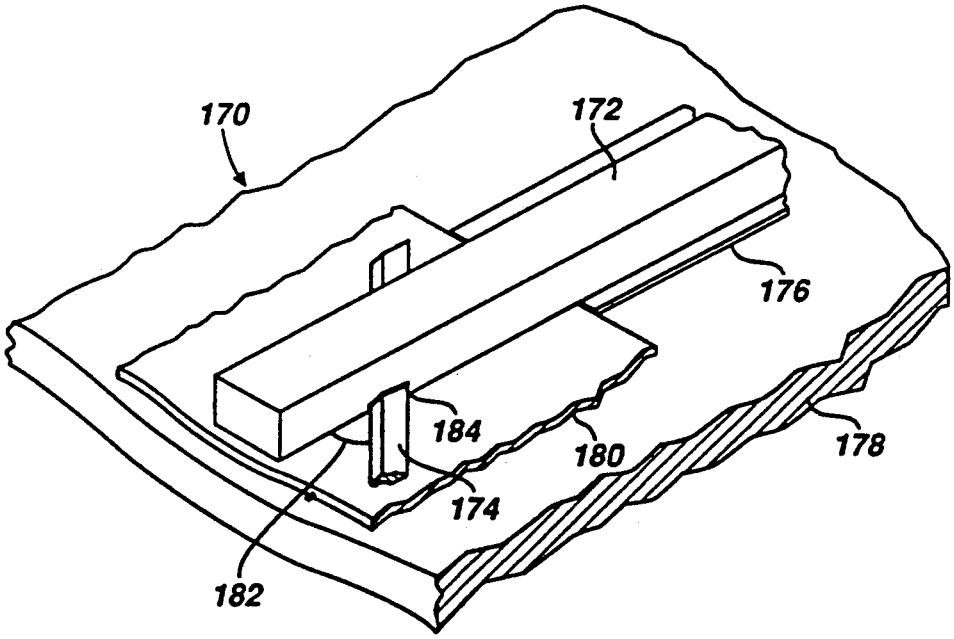
FIG. 4 is a schematic representation illustrating a crossed waveguide structure signal launcher according to the invention.

FIG. 4 is a schematic representation of a crossed waveguide distributed launcher 170 according to the invention for coupling between a high permittivity dielectric waveguide 172 (insular in the illustrated embodiment) and conductive strip transmission line 174. As shown, the dielectric waveguide 172 may include an insular film 176 disposed between the waveguide 172 and a conductive ground plane 178. Also mounted on the ground plane 178 is a conductive strip 174 fixed to a dielectric substrate layer 180, as shown, to form a microstrip transmission line structure. The waveguides 172, 174 are configured to cross at a predetermined angle 182 (less than 90°) with the dielectric waveguide 172 crossing over the conductive strip 174, as shown, to form a coupling region in which the two waveguides are in close proximity. The dielectric substrate material 180 serves as the insular film to support the insular guide 172 in the region of coupling. In addition, in the region or intersection of the two waveguides, an insular film layer 184 may optionally be interposed between the conductive waveguide 174 and the dielectric waveguide 172 to ensure that they do not make direct contact. The launcher 170 is constructed with the conductive strip 174 made very thin and recessed into the dielectric layer 180 or into the insular guide 172. As an example, a typical angle may be 45° and a permittivity value may be 2.25 for the dielectric layer 180 and 10 for the dielectric waveguide 172.

Figure 5:
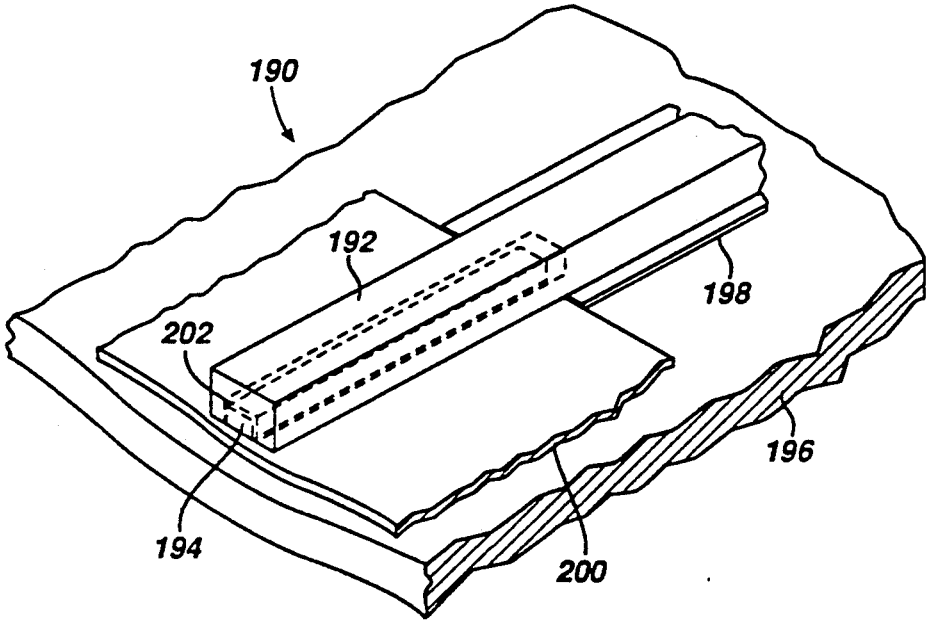
FIG. 5 is a schematic representation illustrating a straddled waveguide structure signal launcher according to the invention.

Referring now to FIG. 5, there is shown a straddled waveguide distributed launcher 190 comprising a dielectric waveguide 192 and a conductive strip transmission line 194. The dielectric waveguide 192 is mounted on the conductive ground plane 196 with an insular film 198 disposed therebetween and extends over a dielectric substrate layer 200 attached to a portion of the ground plane 196, as shown. The thin conductive strip 194 is fixed to the dielectric layer 200 to form a microstrip structure and is configured such that it is completely straddled by the dielectric waveguide 192 over a predetermined length forming a coupling region. This structure is a special case of the crossed waveguide structure of FIG. 4 wherein the crossing angle is 0°. An insular layer 202 may be disposed between the dielectric waveguide and the conductive waveguide to ensure that they do not come in direct contact. This structure may also be constructed utilizing a thin conductive strip recessed into the dielectric layer 200.

The construction of various embodiments of the distributed launcher for the present invention, the materials and dimensions are selected based on conventional known practice for selecting values for dielectric waveguide and microstrip structures. Thus, the microstrip dimensions and materials are chosen to support a single TEM mode of selected nominal constant impedance (e.g., 50 ohms) in the absence of the insular or image waveguide portion. The image or insular waveguide dimensions -=nd materials are similarly selected such that, in the absence of the microstrip portions, the dielectric waveguide supports a sired mode such as the $E_{11}$ || mode and no other higher order E or H modes can exist. In the coupling region, the structure is configured to maximize efficient conversion to transfer electromagnetic energy between modes without generating other modes or generating radiation of the electromagnetic energy.

Figure 6:
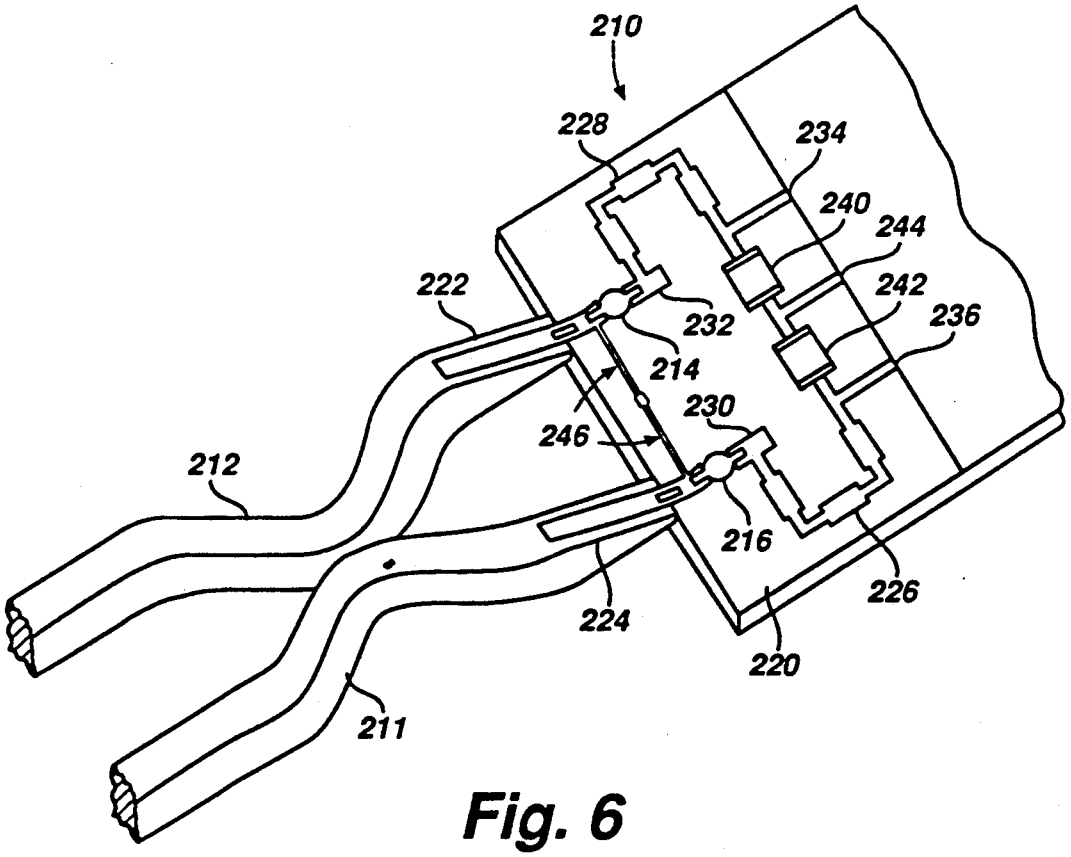
FIG. 6 is a schematic representation illustrating a dielectric waveguide microstrip mixer structure constructed using a tapered signal launcher structure according to the invention.

FIG. 6 is an illustration of a balanced mixer circuit 210 including a quadrature (90° phase shift) hybrid coupler composed of two insular waveguides 211, 212 with the image plane and insular film not shown. The waveguides 211 and 212 of the quadrature hybrid couple local oscillator and radio frequency (RF) input signals to two beam lead Schottky barrier mixer diodes 214, 216 mounted on a microstrip circuit 220. Tapered signal launchers 222, 224 are used to couple between the waveguides 211 and 212 and the microstrip diode mounts, as shown. The microstrip circuit provides intermediate frequency (IF) filtering for the mixer diodes 214, 216. Microstrip circuit includes such common structures as IF filter elements 226, 228; RF grounding shorts 230, 232; diodes bias inputs 234, 236; coupling capacitors 240, 242; RF choke 246; and IF output 244. This mixer circuit 210 illustrates the application of the tapered launcher for converting and coupling between an $E_{11}$ || mode dielectric waveguide structure and a TEM mode microstrip structure for purposes of mounting active devices such as beam lead mixer diodes.

Figure 7A:
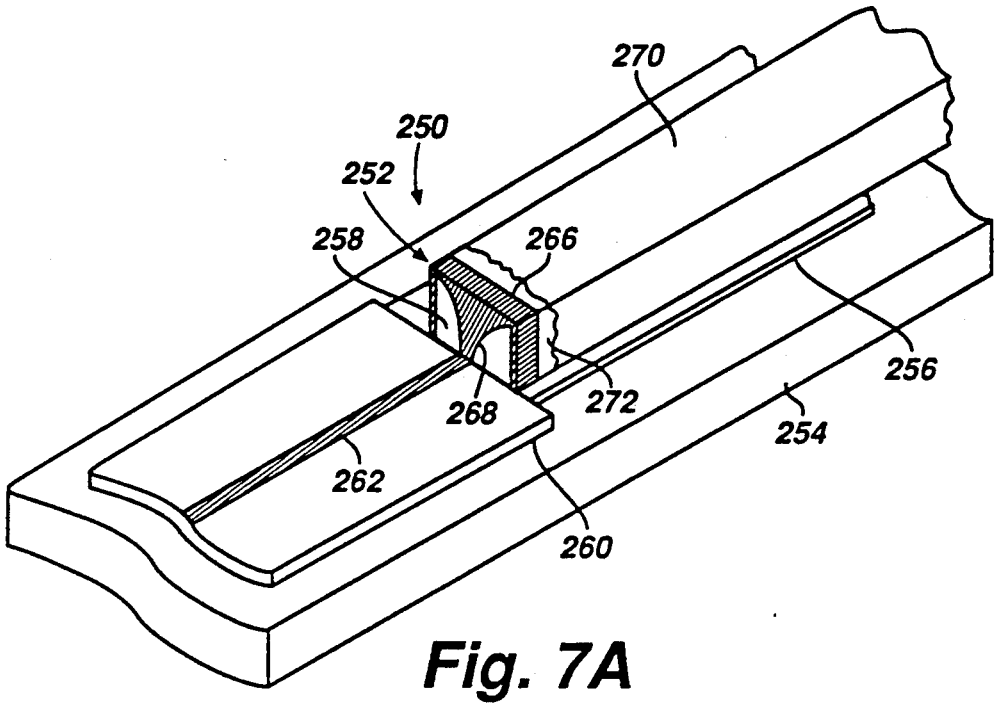
FIG. 7A is a schematic representation illustrating an abrupt coupling signal launcher coupled to a microstrip structure according to the invention.

Referring to FIG. 7A, there is shown a microstrip to dielectric waveguide signal launcher structure 250 which provides abrupt mode conversion and signal coupling. The launcher 250 comprises a short dielectric waveguide portion 252, having insular film 272 and metal film 266 on three sides, mounted on a ground plane 254 which may include an insular film 256 disposed there between. A dielectric waveguide 270 continues from the short launcher portion 252. Adjacent to front face 258 of the waveguide portion 252, a microstrip transmission line 262 is mounted on a d&electric layer 260 attached to the ground plane 254. The launcher 250 comprises a metallic mode shield 266 which forms a narrow metallic sidewall strip on the top and each side of the dielectric waveguide portion 252 at the front face end, as shown. A conductive transition flange 268 is conductably connected to the top strip of the mode shield 266 and to the microstrip waveguide 262. An insular film 272 is disposed on the surface of the waveguide portion 252 such that it is interposed between the metal mode shield 266, and the dielectric waveguide portion 252. The insular film may cover the end face of the dielectric waveguide portion 252 as well.

The sidewall mode shield 266 is provided to trap local modes and prevent sidewall radiation. This metallization acts as a shield only for local modes and does not perturb the primary mode (e.g., $E_{11}$ ||) of propagation in the dielectric waveguide because it is on the outer surface of the sidewall insular film. The metal strip 266 provides efficient coupling to the TEM mode microstrip transmission line.

Figure 7B:
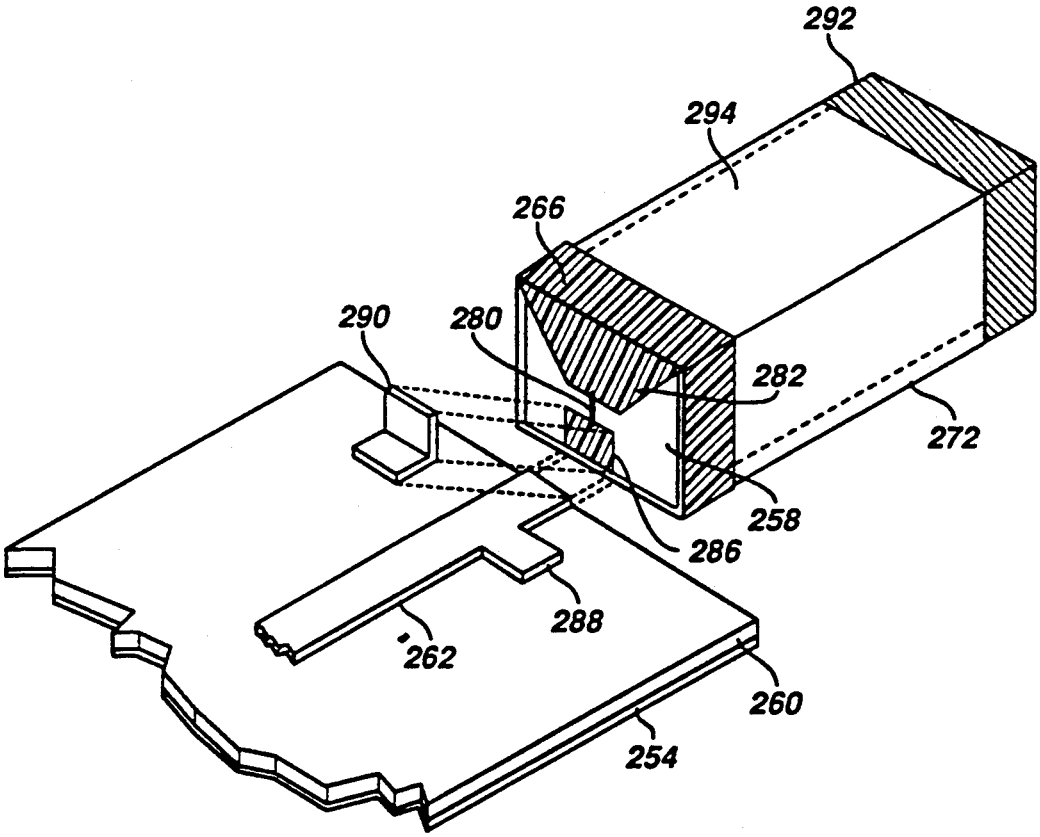
FIG. 7B is a detailed blow up of a schematic representation illustrating an alternative abrupt coupling signal launcher coupled to a microstrip structure according to the invention.

FIG. 7B is an exploded view illustrating an embodiment of the abrupt launcher in which a beam lead diode 280 is mounted on the front wall 258 of a dielectric waveguide portion 294 on a translation flange 282, as shown. The dielectric waveguide portion 294 is a short section with a length of ($n\ \lambda/4$) where $\lambda$ is the wavelength and n is a small (i.e., less than 10) odd integer. The diode 280 is mounted so as to couple signal through it from the transmission line 262 via a translation strip 286 to the dielectric waveguide portion 294. A conductive bonding strap 290 may be used to ensure conductive coupling between the translation strip (e.g. flange) 286 and the microstrip conductive transmission line 262, as shown. A second mode shield 292 may optionally be formed at the second end of the dielectric waveguide portion 294 forming narrow metalization on the top and each side of the dielectric portion 294, as well as covering the end face (i.e., back wall, not shown). This mode shield 292 together with the mode shield 266 forms a stub or cavity which enhances coupling of energy into the diode. This structure is highly suitable for mixer and oscillator structures. An insular film 272 may also be disposed between the surface of the dielectric 294 and the metal mode shields 266, 292. A matching stub 288 is also shown which provides impedance matching, thereby providing improved launcher efficiency.

Specific embodiments of the signal launcher according to the invention have been described for the purpose of illustrating the manner in which the invention may be made and used. It should be understood that implementation of other variations and modifications of the invention in its various aspects will be apparent to those skilled in the art, and that the invention is not limited by the specific embodiments described. It is therefore contemplated to cover by the present invention any and all modifications, variations, or equivalence that fall within the true spirit and scope of the basic underlying principles disclosed and claimed herein.

What is claimed is:

1. A signal launcher for coupling signals of predetermined wavelength between a dielectric waveguide and a TEM mode transmission line comprising:

a conductive ground plane;

an elongated high permittivity dielectric waveguide of predetermined cross section mounted adjacent to the conductive ground plane;

a TEM mode transmission line halving an elongated conductive portion fixed adjacent to a portion of the dielectric waveguide such that the dielectric waveguide and the conductive portion form a distributed coupling region having a length of at least two times the predetermined wavelength; and a film of low permittivity dielectric material disposed between the dielectric waveguide and the conductive portion in the coupling region.

2. The signal launcher of claim 1 wherein a thin low permittivity film of synthetic organic resin is disposed between and secured to both said conductive ground plane and said dielectric waveguide.

3. The signal launcher of claim 1 wherein the dielectric waveguide in the coupling region is tapered towards said ground plane to form a tapered surface and the conductive portion is fixed adjacent to the top of the tapered surface.

4. The signal launcher of claim 3 wherein the TEM mode transmission line comprises a microstrip transmission line structure comprising an elongated conductive strip fixed to a thin layer of dielectric material which is fixed to the surface of the conductive ground plane and wherein in the coupling region the conductive strip is fixed adjacent to the top of the tapered surface.

5. The signal launcher of claim 1 wherein the dielectric waveguide and the conductive portion are configured in parallel and in close proximity to each other in the coupling region.

6. The signal launcher of claim 1 wherein the dielectric waveguide crosses over the conductive portion at a predetermined angle in the coupling region.

7. The signal launcher of claim 6 wherein the conductive portion is recessed into a layer of dielectric material disposed between the ground plane and the conductive portion.

8. The signal launcher of claim 1 wherein the dielectric waveguide is fixed directly on top and in parallel with the conductive portion in the coupling region.

9. The signal launcher of claim 8 wherein the conductive portion is recessed into a layer of dielectric material disposed between the ground plane and the conductive portion.

10. The signal launcher of claim 1 wherein the TEM mode transmission line comprises a microstrip transmission line structure comprising an elongated conductive strip fixed to a thin layer of dielectric material which is fixed to the surface of the conductive ground plane.

11. The signal launcher of claim 1 wherein the TEM mode transmission line comprises a coaxial transmission line comprising an elongated metallic conductor configured as an inner conductor disposed within an outer conductor and wherein a portion of the inner conductor is fixed adjacent to the dielectric waveguide, said outer conductor having one end thereof secured to the surface of the conductive ground plane.

12. A signal launcher for coupling signals of predetermined nominal wavelength between a dielectric waveguide and a TEM transmission line, comprising:

a conductive ground plane;

a high permittivity dielectric waveguide portion having a front face and a back face mounted adjacent to the conductive ground plane;

a conductive mode shield mounted at the front face of the waveguide portion covering a short portion of the outer surface of the waveguide portion including a conductive flange for coupling to the TEM transmission line; and a thin low permittivity film of dielectric material disposed between the conductive mode shield and the dielectric waveguide portion surface.

13. The signal launcher of claim 12 wherein a thin low permittivity film of resin is disposed between the conductive ground plane and the dielectric waveguide portion.

14. The signal launcher of claim 12 wherein the conductive flange comprises a top and a bottom conductive flange coupled together by a diode.

15. The signal launcher of claim 12 wherein a second conductive mode shield is mounted at the back face of the waveguide portion covering a narrow portion of the outer surface and covering the back face of the waveguide portion, and wherein the waveguide portion has a length of n $\lambda/4$ where $\lambda$ is the nominal wavelength and n is a small, odd integer.

16. A signal launcher for coupling signals of predetermined wavelength between a dielectric waveguide and a TEM mode transmission line comprising:

a conductive group plane;

an elongated high permittivity dielectric waveguide of predetermined cross section mounted adjacent to the conductive ground plate;

a TEM mode transmission line having an elongated conductive portion fixed adjacent to a portion of the dielectric waveguide such that the dielectric waveguide crosses over the conductive portion at a predetermined angle to form a distributed coupling region having a length of at least two times the predetermined wavelength; and a thin low permittivity film of synthetic organic resin disposed between and secured to both said conductive ground plane and said dielectric waveguide.

17. The signal launcher of claim 16 wherein a thin film of low permittivity dielectric material is disposed between the dielectric waveguide and the conductive portion in the coupling region where the waveguide and conductive portion cross.

18. The signal launcher of claim 16 wherein the TEM mode transmission line comprises a microstrip transmission line structure comprising an elongated conducive strip fixed to a thin layer of dielectric material which is fixed to the surface of the conductive ground plane.

19. A signal launcher for coupling signals of predetermined wavelength between a dielectric waveguide and a TEM mode transmission line comprising:

a conductive ground plane;

an elongated high permittivity dielectric waveguide of predetermined cross section mounted adjacent to the conductive ground plane;

a TEM mode transmission line having an elongated conductive portion fixed adjacent to a portion of the dielectric waveguide such that the dielectric waveguide and the conductive portion form a distributed coupling region having a length of at least two times the predetermined wavelength wherein a thin film of low permittivity dielectric material is disposed between the dielectric waveguide and conductive portion in the coupling region and wherein the dielectric waveguide is fixed directly on top and in parallel with the conductive portion in the coupling region; and a thin low permittivity film of synthetic organic resin disposed between and secured to both said conductive ground plane and said dielectric waveguide.

20. A signal launcher for coupling signals of predetermined wavelength between a dielectric waveguide and a TEM mode transmission lines comprising:

a conductive ground plane;

an elongated high permittivity dielectric waveguide of predetermined cross section mounted adjacent to the conductive ground plane;

a TEM mode transmission line having an elongated conductive portion fixed adjacent to a portion of the dielectric waveguide such that the dielectric waveguide crosses over the conductive portion at a predetermined non-zero angle such that the conductive portion is between the dielectric waveguide and the ground plane to form a distributed coupling region having a length of at lest two times the predetermined wavelength.

21. The signal launcher of claim 20 wherein the conductive portion is recessed into a layer of dielectric material disposed between the ground plane and the conductive portion.

* * * * *

UNITED STATES PATENT AND TRADEMARK OFFICE

CERTIFICATE OF CORRECTION

PATENT NO. : 5,107,231

DATED : April 21, 1992

INVENTOR(S) : Robert M. Knox

It is certified that error appears in the above-identified patent and that said Letters Patent is hereby corrected as shown below:

Column 3, lines 14, 37, 59, 60 and 63 the symbol "$E_{11}$" should read --$E_{11}^{y}$--.

Column 4, lines 15 and 48, the symbol "$E_{11}$" should read --$E_{11}^{y}$--.

Column 5, lines 4, 11, 15 the symbol "$E_{11}$" should read --$E_{11}^{y}$--;

line 28, "dispersed" should read --disposed--;

line 48, the symbol "$E_{11}$" should read --$E_{11}^{y}$--.

Column 6, line 22, "dielectric waveguide" should read --waveguide dielectric--.

Column 7, line 64, "=nd" should read --and--;

line 66, "sired" should read --desired--;

line 67, the symbol "$E_{11}$" should read --$E_{11}^{y}$--.

Column 8, line 23, the symbol "$E_{11}$" should read --$E_{11}^{y}$--;

line 36, "d&electric" should read --dielectric--;

UNITED STATES PATENT AND TRADEMARK OFFICE
CERTIFICATE OF CORRECTION

PATENT NO. : 5,107,231

DATED : April 21, 1992

INVENTOR(S) : Robert M. Knox

It is certified that error appears in the above-identified patent and that said Letters Patent is hereby corrected as shown below:

line 53, the symbol "$E_{11}$" should read --$E_{11}^{y}$--.

Column 9, line 37, "halving" should read --having;

Column 10, line 60, "plate" should read --plane--.

Signed and Sealed this

Thirtieth Day of November, 1993

Bruce Lehman

*Attest:*

BRUCE LEHMAN

*Attesting Officer*

*Commissioner of Patents and Trademarks*